United States Patent [19]

Haydon

[11] 4,011,971

[45] Mar. 15, 1977

[54] DEVICE FOR DISPENSING LIQUIDS FROM A SEALED CONTAINER AND FOR PRESERVING UNDISPENSED PORTIONS THEREOF

[75] Inventor: Edward R. Haydon, Steamboat Springs, Colo.

[73] Assignee: Edward R. Haydon, Steamboat Springs, Colo.

[22] Filed: Dec. 29, 1975

[21] Appl. No.: 644,933

[52] U.S. Cl. ..... 222/399

[51] Int. Cl.[2] ..... B65D 83/14

[58] Field of Search ..... 426/477, 474, 487, 486, 426/15, 404; 222/399

[56] References Cited

UNITED STATES PATENTS

| | | | |
|---|---|---|---|
| 2,208,490 | 7/1940 | Axtell et al. | 222/399 |
| 2,301,416 | 11/1942 | Krug | 222/399 |
| 3,352,457 | 11/1967 | Tracy et al. | 222/399 X |
| 3,367,538 | 2/1968 | Hasselbeck et al. | 222/399 |
| 3,420,418 | 1/1969 | Rousset et al. | 222/399 |
| 3,442,657 | 5/1969 | Bonnet et al. | 426/404 |
| 3,869,557 | 3/1975 | Vrespa | 426/404 X |

*Primary Examiner*—Stanley H. Tollberg
*Assistant Examiner*—Norman L. Stack, Jr.

[57] ABSTRACT

A method of and device for dispensing liquids from sealed containers such as wine bottles is disclosed, and for replacing the dispensed liquids with an innoxious gas at a preselected pressure to prevent spoilage of undispensed portions of the liquid.

1 Claim, 3 Drawing Figures

DEVICE FOR DISPENSING LIQUIDS FROM A SEALED CONTAINER AND FOR PRESERVING UNDISPENSED PORTIONS THEREOF

BACKGROUND OF THE INVENTION

The present invention relates generally to liquid dispensers and more particularly to a device adapted to be operatively connected to a sealed container of liquid to facilitate dispensing of the liquid and preserved undispensed portions of the liquid and also relates to the method performed with such a device.

When a bottle or container of table wine, or other perishable liquid, is opened in a home, restaurant or bar, the contents must be consumed in a reasonably short period of time to prevent degredation of quality and subsequent spoilage from contact with ambient air. In the case of wine, it is known that spoilage results from contact with the 200-odd yeast spores in the air. Of course, these yeast spores are exposed to the wine once the bottle is opened and the air carrying the yeast spores replaces the wine removed from the bottle so that the remaining undispensed wine in the bottle is subject to spoilage from the air.

Accordingly, there has been a long felt need for a method or system for preserving unused portions of perishable liquids such as wine so that the entire contents of a container of such a perishable liquid does not need to be consumed at any one setting but can rather be consumed over an extended period of time.

OBJECTS OF THE INVENTION

It is a primary object of the present invention to provide a new and improved method and device for preserving unused portions of a perishable liquid in a sealed container.

It is another object of the present invention to provide a unified device for dispensing liquids from a sealed container and for preserving undispensed portions of the liquids.

It is another object of the present invention to provide a new and improved method of and device for dispensing liquids from a sealed container and for preserving undispensed portions of the liquid in the sealed container by replacing the dispensed liquid with an innoxious gas under a preselected pressure.

SUMMARY OF THE INVENTION

The device of the present invention is adapted to be incorporated into a container of the type sealed by a cork closure or the like and includes means for selectively allowing liquids in the container to flow therefrom and be replaced by an innoxious gas which will prevent the liquid in the container from spoiling. While the disclosure is made in connection with bottle-type containers of wine having cork closures, it will be appreciated that the device of the present invention would be useful with similar containers of other perishable goods such as champagne, beer, non-alcoholic beverages, food products, drugs, chemicals, biotics, etc.

The device of the present invention includes a tubular member adapted to penetrate a cork-type closure to place the tubular member in fluid communication with the interior of the sealed container. The tubular member has two passages with one adapted to allow the free flow of liquid from the container and the other adapted to allow the inflow of an innoxious gas to replace the removed liquid. The passage adapted to allow the inflow of an innoxious gas is connected to a compartment in a housing mounted on the tubular member having an innoxious gas retained under pressure. Valve means are provided in the housing to allow the innoxious gas to flow into the container when the pressure in the container is below a preselected level.

The valve includes a pressure sensitive diaphragm, the flexing characteristics of which are selectively influenced by a resilient member also contained in the housing so that the desired pressure level to be maintained in the container can be regulated by the pressure necessary to flex the diaphragm. The valve is designed to not only replace removed liquid with innoxious gas at a predetermined pressure, but is also adapted to relieve the container of pressure which is in excess of the desired pressure.

The method of the invention includes the basic steps of selectively removing liquid from a sealed container and replacing the removed liquid with an innoxious gas.

Other objects, advantages and capabilities of the present invention will become more apparent as the description proceeds taken in conjunction with the accompanying drawings.

DESCRIPTION OF THE PREFERRED EMBODIMENT

Figure 1:
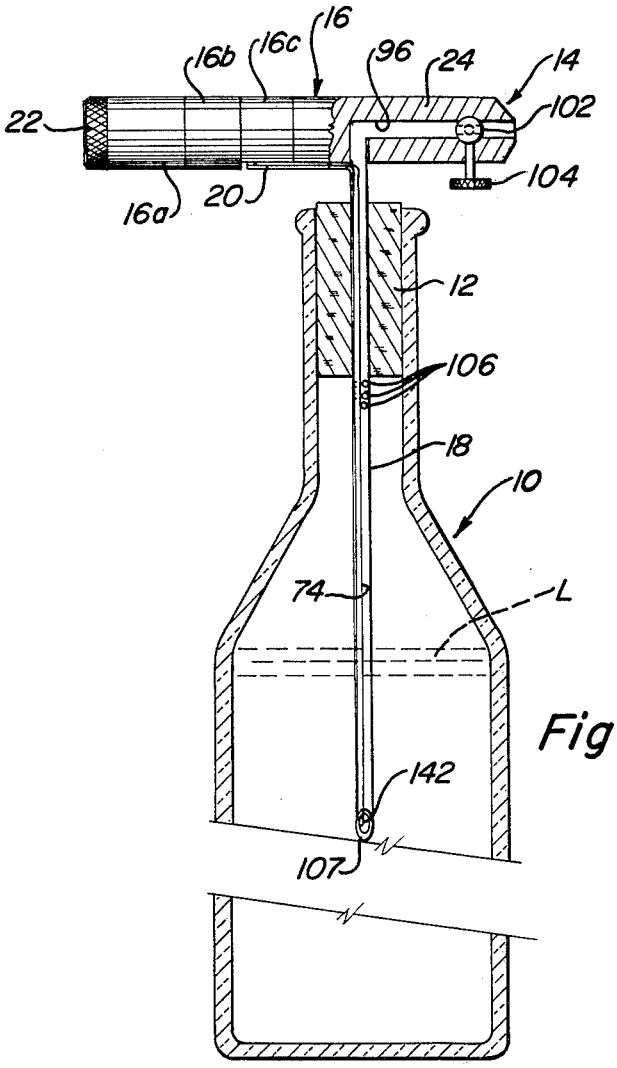
FIG. 1 is a vertical section taken through a bottle-type container having a cork closure and the device of the present invention operatively connected thereto.

Referring first to FIG. 1, a bottle-type container 10 having a cork closure 12 sealed in its neck, is shown having a quantity of liquid L, for example a perishable wine, therein. The device 14 of the present invention is shown operatively connected to the bottle and can be seen to include a housing member 16 disposed horizontally across the top of the bottle and a pair of tubular members, namely a dispensing tube 18 and a pressure tube 20, passing from the housing into the container through the cork closure.

Figure 2:
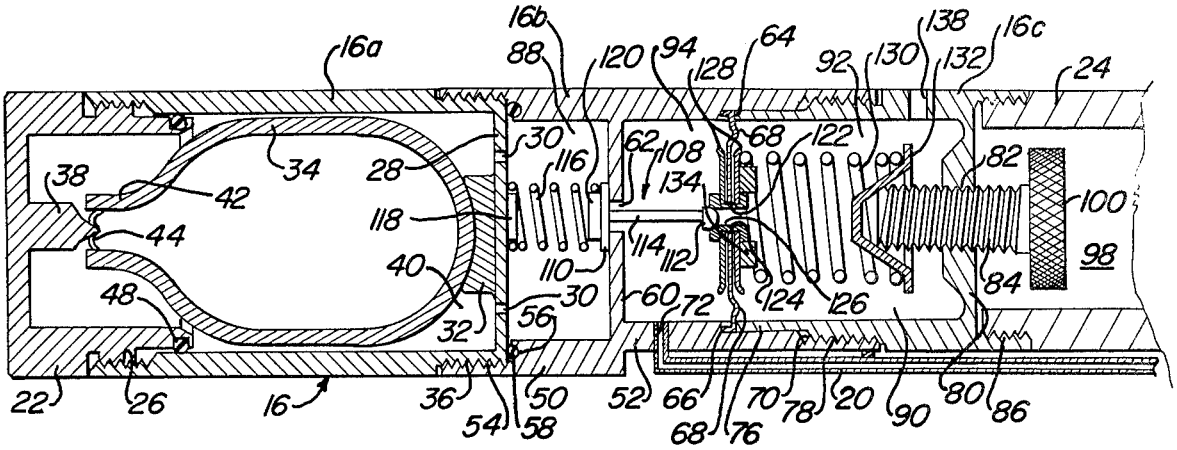
FIG. 2 is a fragmentary vertical section taken through the device of the present invention.
Figure 3:
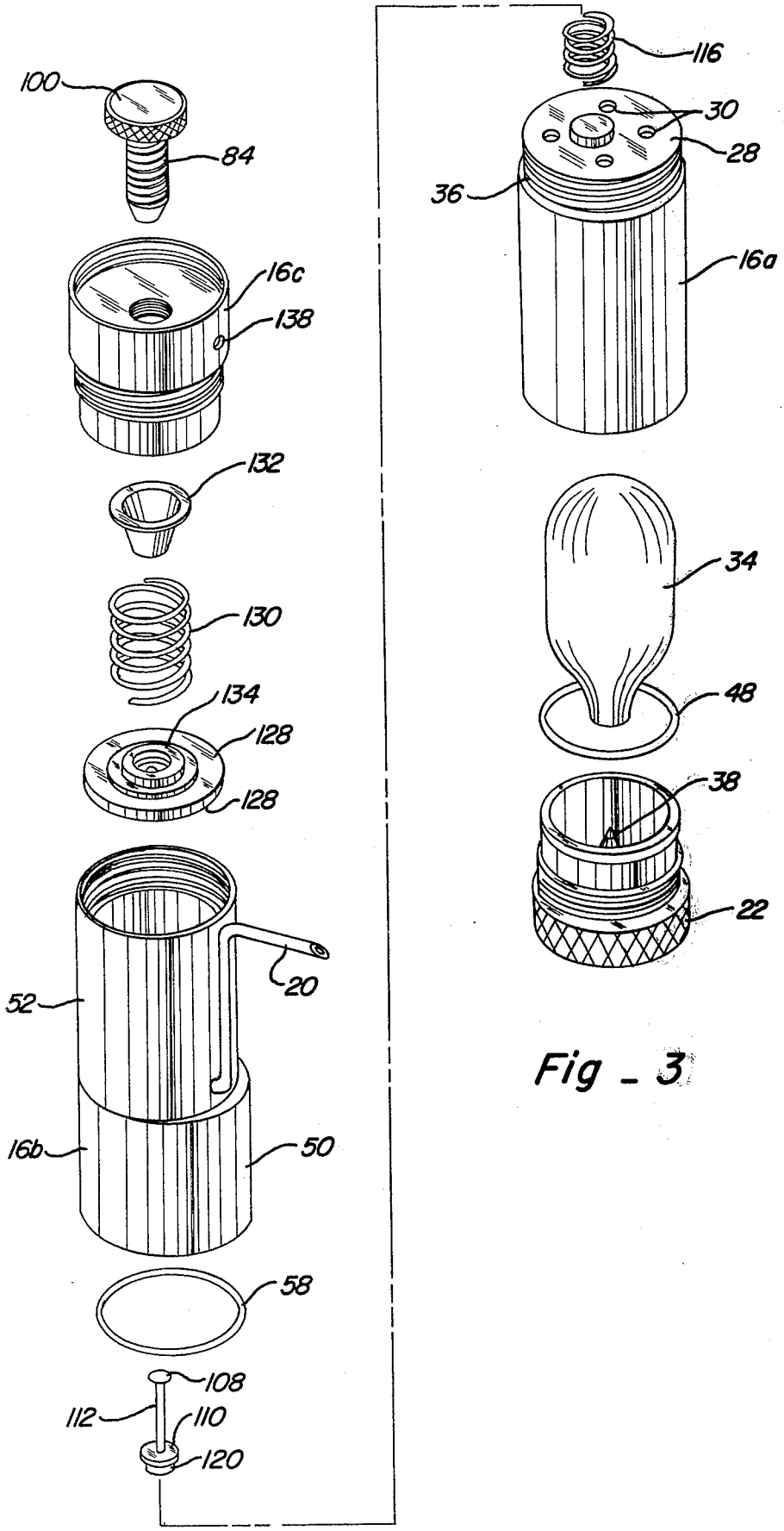
FIG. 3 is an exploded perspective view of a portion of the device of the present invention.

As is best seen in FIGS. 2 and 3, the housing 16 includes trailing, intermediate and leading housing sections **16*a*, 16*b* and 16*c* respectively, an end cap 22 on the trailing housing section 16*a* and a dispensing cylinder 24**. Each component of the housing is of generally cylindrical configuration and is threadedly connected to an adjacent component.

The trailing housing section **16*a* has an internally threaded trailing end 26 adapted to threadably receive the end cap 22. The leading end of the trailing housing section has an end wall 28, which will be referred to as a bulkhead, having perforations 30 therethrough. A concave cylinder seat 32 is mounted on the rear side of the bulkhead 28 for retaining a compressed gas cylinder or canister 34. The cylinder may be of the type which is commercially available for supplying charges of innoxious gas such as carbon dioxide ($C0_2$). The leading end of the trailing housing section 16*a* has external threads 36 thereon adapted to threadedly receive the trailing end of the intermediate housing section 16*b*** as will be discussed later.

The closure cap 22 has a centrally disposed puncture stem 38 protruding into a pressurized compartment 40 defined by the trailing housing section 16*a* and the end cap 22, and the puncture stem 38 has a sharpened leading end adapted to align with the neck 42 of the compressed gas cylinder 34 to puncture a sealing membrane 44 therein to release gas from the cylinder so that the gas can pressurize the compartment 40 defined by the trailing housing section and the end cap. As will be appreciated, the end cap also has a circular groove 46 receiving an 0-ring 48 to establish a hermetic seal between the trailing housing section and the end cap.

The intermediate housing section 16*b* has two cylindrical body portions 50 and 52 of different diameter as is probably best illustrated in FIG. 3. The trailing body portion 50 of the intermediate housing section is of larger diameter than the leading housing portion 52 and has internal threads 54 therein adapted to be threaded onto the external threads on the leading end of the trailing housing section 16*a*. Further, a groove 56 is provided in the trailing body portion 50 to receive an O-ring 58 which establishes an hermetic seal between the intermediate and trailing housing sections. The trailing body portion 50 of the intermediate housing section 16*b* is separated from the leading body portion 52 by a partition 60 having a centrally located opening or passage 62 therethrough. The internal annular wall of the leading body portion 52 is provided with a shoulder 64 and sealing groove 66 which seats and retains the peripheral edge of a diaphragm 68 as will be explained more clearly later. The leading end of the intermediate housing section 16*b* is internally threaded at 70 to receive the trailing end of the leading housing section 16*c*. The leading body portion 52 has a lateral opening 72 therein which receives the inner end of the pressure tube 20 which extends axially along the side of the leading body portion to a point where the tube 20 passes through a right angle bend and thence extends perpendicularly away from the housing in an elongated straight section 74, so that it can be inserted into the bottle 10 or other container from which liquids are to be dispensed. In the embodiment disclosed, the pressure tube 20 passes into the dispensing tube 18, which will be described later, so that the elongated straight section 74 thereof is confined within the dispensing tube which is of a larger diameter to allow the free flow of liquids from the container.

The leading housing section 16*c* is of the same diameter as the leading body portion 52 of the intermediate housing section 16*b* and has a rearwardly extending cylindrical extension 76 of reduced diameter which is adapted to abut the shoulder 64 in the internal surface of the leading body portion to assure that the diaphragm 68 is securely clamped inside the housing. Immediately forwardly of the rearward cylindrical extension 76, the leading housing section has external threads 78 adapted to receive the internal threads 70 on the intermediate body section so that the intermediate and leading housing sections can be releasably united. The leading housing section 16*c* has a leading end wall 80 with a threaded centrally located opening 82 therein threadedly receiving an adjustment screw 84, to be described in more detail later, and a forward cylindrical extension 86 having internal threads therein adapted to threadedly receive the dispensing cylinder 24, the function of which will be described later.

In summary, it will be appreciated that the housing sections 16*a*, 16*b* and 16*c*, the end cap 22 and dispensing cylinder 24 cooperate in defining the substantially cylindrical elongated housing 16. Further, it will be appreciated that the trailing housing section 16*a* cooperates with the end cap 22 in defining the pressurized compartment 40, and with the trailing body portion of the intermediate housing section in defining a plug valve compartment 88. Also, the intermediate housing section 16*b* cooperates with the leading housing section 16*c* in defining a diaphragm compartment 90 which is divided into forward and rearward sections 92 and 94 respectively by the diaphragm.

As is best illustrated in FIG. 1, the dispensing cylinder 24 can be seen to be substantially solid in its forward end with an L-shaped liquid dispensing passage 96 therethrough and hollow at its rearward end 98 for receiving the head 100 of the adjustment screw 84. A butterfly valve 102 is positioned in the dispensing passage 96 and has an operating head 104 extending laterally away from the dispensing cylinder in a position to be finger-operated by a user of the device to open and close the dispensing passage for control of the flow of liquids from the container. Of course, the dispensing tube 18 is inserted into the dispensing cylinder and retained therein in a conventional manner to be in fluid communication with the dispensing passage.

As illustrated in FIG. 1, the dispensing tube 18 has perforations 106 therein at a location near the center of its length so that liquids can flow laterally through the perforations and into the interior of the dispensing tube for removal from the container. The location of the perforations is selected so as to be fairly close to the bottom of conventional corks used in wine bottles but of course could be varied depending upon the length of the cork through which the dispensing tube extends, the important factor being that the perforations be near the bottom of the cork so that all of the liquid can be removed from the bottle by inverting the bottom as is customary when removing liquid contents from such a container. The terminal end 107 of the dispensing tube is sharpened so that the tube will readily penetrate a cork-type closure. Further, the dispensing tube is hollow and larger in diameter than the pressure tube so that the pressure tube will fit in the interior of the dispensing tube and still leave room for the free flow of liquids through the dispensing tube.

A plug valve 108 having a cylindrical head 110 on one end, a ball head 112 on the opposite end, and a plug valve stem 114 connecting the cylindrical head to the ball head extends through the central opening 62 in the partition 60 in the intermediate housing section so that the cylindrical head 110 is disposed in the plug valve compartment 88 and the ball head 112 in the diaphragm compartment 90. A plug valve spring 116 rests against the cylindrical head and abutts against the perforated bulkhead 28 to bias the plug valve 108 in a forward direction. A plug valve spring guide 118 is mounted on the forward surface of the bulkhead to retain the position of the plug valve spring and similarly a plug valve spring seat 120 is mounted on the rear surface of the cylindrical head 110 of the plug valve to retain the leading end of the spring. The operation of the plug valve will be explained later.

The diaphragm 68 has a centrally located opening 122 therethrough which receives a flanged cylinder 124 defining a passage or port 126 therethrough. Seating disks 128 are also disposed on opposite sides of the diaphragm and retained in position by the flanges on the flanged cylinder 124. The ball head 112 on the plug valve is positioned so as to be seated in the trailing end of the flanged cylinder 124 when the cylindrical head 110 of the plug valve is abutted against the partition 60 and in a manner such that when the diaphragm is normally disposed, as in FIG. 2, the ball head of the plug valve hermetically seals the port 126 preventing the passage of fluids therethrough and the cylindrical head 110 hermetically seals the openings 62 through the partition 60 to prevent the passage of fluids therethrough. Of course, the materials of which these cooperating elements are made are selected to effect the hermetic seals described.

A main spring 130 is disposed in the leading housing section 16*c* and its trailing end abutted against the seating disk 128 on the leading side of the diaphragm 68 and its leading end abutted against a main spring seat 132 carried on the trailing end of the abutment screw 84. The main spring seat 132 is of generally frusto conical configuration to retain the position of the main spring at its leading end and the trailing end of the spring is retained in position by a main spring guide 134 mounted on the leading end of the flanged cylinder 124. It will thus be appreciated that the main spring 130 exerts a rearward biasing force on the diaphragm which is resisted beyond the normal position shown in FIG. 2 by the plug valve spring 116 via the plug valve 108. The main spring further yieldingly resists forward flexing of the diaphragm and the degree of resistance is variable by the adjustment screw 84.

The cooperation of the aforedescribed elements in effecting the desired operation of the device will be described hereafter but as a preliminary statement it will be seen that the device allows liquid to flow from the container 10 through the dispensing tube 18 and cylinder 24 at a selected rate and the liquid removed from the container is replaced by innoxious gas, originally contained in the compressed cylinder 34, which is allowed to flow into the container to maintain a desired pressure in the container.

To prepare the device for use, a compressed air cylinder 34, of the type illustrated, which is commercially available, is inserted into the trailing housing section 16*a* with the neck of the cylinder directed rearwardly so that as the end cap 22 is screwed onto the trailing housing section, the puncture stem 38 will penetrate the sealing membrane 44 in the neck of the compresed gas cylinder to release the gas into the pressurized compartment 40 and subsequently across the perforated bulkhead into the plug valve compartment 88. If the gas is to act as a preservative when injected into the container, it should be an innoxious gas such as carbon dioxide ($CO_2$). As will be appreciated, the gas is sealed in the pressurized compartment and the plug valve compartment by the O-rings and by the seating of the cylindrical head 110 of the plug valve 108 against the partition 60. The pressure in the forward portion 92 of the diaphragm compartment is at atmospheric pressure, due to a vent opening 138 which establishes fluid communication between the ambient environment and the forward portion of the diaphragm compartment. Advancement of the adjustment screw 68 in a rearward direction into the forward portion 92 of the diaphragm compartment compresses the main spring 130 increasing the bias exerted thereby on the diaphragm. Rearward flexing of the diaphragm under the bias of the main spring, is yieldingly resisted by the plug valve spring 116 which biases the plug valve 108 in a forward direction.

As will be appreciated, the pressure in the rearward portion 94 of the diaphragm compartment, i.e. that portion of the compartment rearwardly of the diaphragm 68, is pressurized at the pressure exposed to the distal or outer end 142 of the pressure tube, which is the pressure in the sealed container once the pressure tube is inserted into the container through the cork closure 12. If the pressure in the container is greater than a predetermiend value selected by the axial position of the adjustment screw 84, the pressure in the rearward portion 94 of the diaphragm compartment will overcome the bias of the main spring 130 and will force the diaphragm to flex in a forward direction unseating the ball head 112 of the plug valve 108 from its sealed relationship with the flanged cylinder 124 so that the pressure is relieved via the port 126 through the flanged cylinder, the forward portion 92 of the diaphragm compartment, and the vent opening 138. The pressure continues to be relieved until the bias of the main spring overcomes the pressure exerted against the diaphragm from the rearward portion 94 of the diaphragm compartment causing the diaphragm to flex back to its normal position shown in FIG. 2 wherein the ball head on the plug valve seals the port 126 preventing any further passage of fluid out of the rearward portion of the diaphragm compartment. When this occurs it will be obvious that the pressure in the container is equal to that of the preselected pressure which was selected by axial movement of the adjustment screw. As will be apparent, if the adjustment screw were retracted so that the main spring did not exert a bias on the diaphragm, the pressure in the container would be balanced with ambient atmospheric pressure.

If the pressure in the container is below the preselected pressure, the main spring 130 will force the diaphragm 68 to flex in a rearward direction thereby forcing the plug valve 108 to move in a rearward direction against the bias of the plug valve spring 116 thereby removing the cylindrical head 110 of the plug valve from its seat against the partition 60 and thereby opening the passage 62 through the partition so that the innoxious gas can flow through the opening into the rearward portion 94 of the diaphragm compartment, the pressure tube 20 and into the container 10 until the pressure in the container is raised to the preselected pressure at which time the plug valve spring 116, assisted by the pressure in the rearward portion 94 of the diaphragm compartment forces the diaphragm to return to its normal position of FIG. 2 and effects a reseating of the cylindrical head 110 of the plug valve against the partition 60 so that there is no further transfer of gas from the pressurized plug valve compartment 88 into the container.

As will be appreciated, the pressure in the container can be maintained at any preselected level by the device of the present invention and, as liquid is poured from the container by inverting the container allowing the liquid to flow through the perforations 106 into the dispensing tube 18, and subsequently through the butterfly valve 102, consequently lowering the pressure in the container, the device will operate as described before to allow the pressurized innoxious gas to flow through the pressure tube into the container to replace the liquid which was dispensed therefrom. Accordingly, the liquid is replaced with an innoxious gas which does not have detrimental affect on the liquid in the bottle and will prevent the liquid from spoiling. Accordingly, perishable liquids can be preserved by utilizing the device of the present invention.

It should be noted that while the pressure tube 20 does not extend completely to the bottom of the container from which the liquid is being dispensed, it has been found by experiment that the innoxious gas will replace liquid removed from the container even when the liquid level is above the end 142 of the pressure tube when the bottle is inverted. Further, it has been found that due to the relatively small size of the pressure tube relative to the dispensing tube 18, and due to the relatively high pressure in the pressure tube relative to that in the dispensing tube when the butterfly valve is open, liquids will not flow into the pressure tube and will flow through the dispensing tube and ultimately out of the device into the object glass or other article (not shown) into which the liquids are to be dispensed.

While it can be appreciated that the pressure in the container can be maintained at any desired pressure, it has been found desirable to maintain the pressure at ambient atmospheric pressure as higher pressures have a tendency to cause the innoxious gas to dissolve in the liquid. Accordingly, it is preferable that the adjustment screw be retracted to an extent such that it does no affect the operation of the diaphragm. In this manner, the pressure in the container will be maintained at the ambient atmospheric pressure.

Although the present invention has been described with a certain degree of particularity, it is understood that the present disclosure has been made by way of example and that changes in details of structure may be made without departing from the spirit thereof.

What I claim is:

1. A device for preserving perishable liquids in a container sealed by a cork-type closure and for providing means for selectively removing the liquids from the container comprising:

an elongated housing having first and second compartments, said compartments being separated by a partition having an opening therethrough, means for releasably retaining a pressurized canister of an innoxious gas in said first compartment and means for puncturing such a canister to release the gas therein into the first compartment, a diaphragm in said second compartment dividing the compartment into first and second sections, and resilient means in said second section yieldingly resisting flexing movement of the diaphragm into the second section, said housing having a vent opening therethrough in communication with said second section such that said second section is pressurized at the ambient atmospheric pressure, closure means operatively connected to said diaphragm for selective movement therewith, said closure means normally operative to close said opening in the partition between compartments but movable with selected movement of the diaphragm to open said opening, first conduit means in fluid communication with said first section and having means adapted to enable the conduit to penetrate the cork-type closure of the container to establish fluid communication between the first section and the interior of said bottle such that innoxious gas can be selectively transferred from the housing to the container, second conduit means connected to said housing and also having means adapted to enable the second conduit to penetrate the cork-type closure of the container, said second conduit providing means for removing liquid from the container, and valve means in said second conduit means to control the flow of liquid therethrough.

* * * * *